United States Patent [19]

Fiore

[11] Patent Number: 4,511,887

[45] Date of Patent: Apr. 16, 1985

[54] LONG RANGE WIRELESS ALARM MONITORING SYSTEM

[75] Inventor: Louis T. Fiore, Larchmont, N.Y.

[73] Assignee: Radionics, Inc., Salinas, Calif.

[21] Appl. No.: 579,852

[22] Filed: Feb. 13, 1984

Related U.S. Application Data

[63] Continuation of Ser. No. 302,125, Sep. 14, 1981, abandoned.

[51] Int. Cl.[3] ..... G08B 26/00

[52] U.S. Cl. ..... 340/539; 340/505; 340/514; 340/518; 340/346; 340/825.54; 340/825.04; 455/51; 455/54; 179/5 R

[58] Field of Search ..... 340/502-506, 340/514, 518, 539, 526, 531, 536, 318, 345, 346, 825.1, 825.14, 825.36, 825.54, 825.69, 825.72; 455/9, 11, 73, 49, 51, 53, 54, 63, 65; 343/6.5 R, 6.5 SS, 6.8 R; 179/5 R, 5 P

[56] References Cited

U.S. PATENT DOCUMENTS

| | | | |
|---|---|---|---|
| 3,256,517 | 6/1966 | Saltzberg et al. | 340/518 |
| 3,418,579 | 12/1968 | Hultberg | 455/51 |
| 3,508,260 | 4/1970 | Stein | 340/505 |
| 3,593,138 | 7/1971 | Dunn | 455/51 |
| 4,191,948 | 3/1980 | Stockdale | 340/539 |
| 4,222,052 | 9/1980 | Dunn | 340/505 |

*Primary Examiner*—Donnie L. Crosland
*Attorney, Agent, or Firm*—Pennie & Edmonds

[57] ABSTRACT

A security system using a remote sensing unit and a transponder in either one-way or two-way radio communication with a central station. The security system provides for the continuous monitoring of remote points in a particular area from a central station without need of physical connections between the central station and the remote points. The security system further provides the added feature of using redundant code comparison to ensure the validity of the transmitted signal.

4 Claims, 9 Drawing Figures

LONG RANGE WIRELESS ALARM MONITORING SYSTEM

This is a continuation of application Ser. No. 302,125 filed Sept. 14, 1981, now abandoned.

TECHNICAL FIELD

This invention relates to a remotely monitored security system; and, in particular, to a security system comprised of remote responding stations capable of wirelessly transmitting long range coded signals, relating to sensed conditions, to a central station that uses redundant code comparison to ensure the validity of the transmitted signal.

BACKGROUND ART

Well known in the prior art are security systems that transmit coded signals to a central station in the event an alarm condition exists. Also known in prior art security systems is the general concept of wireless alarm monitoring where the monitored stations are responsive to a clock signal transmitted by the central station. Nowhere in the prior art, however, is there disclosed a security system that has the capability of using a pre-existing radio transmitter in either one-way or two-way configurations, nor does the prior art show the expanded signal processing capability available in this invention. Finally, no prior art system discloses a signal validating process utilizing redundant code comparison as is provided in the present invention.

U.S. Pat. No. 3,508,260 to Stein for "Transponder Monitoring System" discloses a security system having a central station, with a separate channel for each responder, and remote responder stations which regularly signal the central station in the absence of an alarm condition. A major advance of the present invention lies in its use of the signal-on-change logic, thus eliminating the rather complicated resetting method of Stein. Another advantage of the present invention rests in the use of a digitalized signal to transmit information between the central station and the remote responder stations. Finally, the Stein system is inherrently a two-way system while the present invention is not so limited.

U.S. Pat. No. 4,257,038 to Rounds et al. for "Coded Security System" discloses a security system comprising a central station and nearby signal units that transmit coded signals which indicate whether a security alarm is enabled or disabled. The device of Rounds et al. is a simple one-way communication device not intended for the complex signal processing envisioned by the present invention. The present invention, unlike that of Rounds et al., has the facility for two-way radio communication and is capable of using a pre-existing transmitter. In addition, the patent to Rounds et al. discloses a test mode which is far different from that of the present invention; it requires actual human intervention to be activated. Nothing disclosed in the patent to Rounds et al shows. test means for measuring signal validity. The security system of the present invention overcomes these disadvantages by being capable of automatically testing the viability of the remote station and measuring the validity and strength of the signal received from the remote station.

U.S. Pat. No. 3,949,397 to Wagner et al. for "Identification—Friend or Foe System and Method" discloses a process for testing the validity of a response signal. The method involves setting up a protocol which allows a response signal to be used only once during a particular time interval so that a second signal transmitted within the same time interval will be recognized as spurious. The protocol requires complicated programming that is unnecessary in the present invention's use of redundant code comparision.

U.S. Pat. No. 4,067,008 to Sprowls for "Multiplex Interrogation System" discloses a security system which requires physically linking the central station to the remote sensing units. The Sprowls system requires the central station to address each remote sensing unit sequentially. This method is very limited and time consuming. By contrast, the present invention is capable of signaling each remote responder station directly or randomly, as well as sequentially, thus overcoming the prior art limitations. This also results in significant time savings not available in the prior art.

U.S. Pat. No. 3,336,591 to Michnick for "One-Way Range and Azimuth System for Stationkeeping" discloses a one-way system in which time clocks are associated with each remote sending unit. In the two-way configuration, the security system of the present invention dispenses with the need for timing units located at the remote responder stations. This is accomplished by the central station of the present invention which is capable of transmitting a periodic synchronizing signal interrogating the remote responder station. Finally, the present invention is capable of transmitting more varied information than is possible in the system of Michnick.

BRIEF SUMMARY OF THE INVENTION

The security system of the present invention overcomes the encumbrances evident in the foregoing prior art systems. The invention is essentially comprised of a central or master station and remote responder stations further comprised of remote sensing units and transponders. The central or master station is capable of using a pre-existing radio transmitter, thus resulting in a significant cost advantage over prior art systems. Also, provision is made for testing the validity of the remote responder's signal by using redundant code comparision. The response from each transponder located at the remote responder stations consists of a unique multi-bit word which is repeated so the interrogating system located at the master or base station can compare the original and repeated multi-bit word to ensure that a proper response, whether it be the presence or absence of an alarm condition, has been received. Two possible configurations are envisioned: a one-way system or a two-way system.

In the one-way system, the remote responder units signal the central station only when there is a change of state in one of the remote sensing units. Provision is made for testing the remote responder stations on a daily or more frequent basis given the particular application. For instance, a system installed in a jewelry store may require testing far more often than once a day, while daily testing would be adequate for most home uses.

In the two-way system the central station acts as a master station interrogator, transmitting a periodic synchronizing signal to the remote responder stations. The transponders located at the remote responder stations reply with time division multiplexed signals based upon a timing frame which is in turn dependent upon the synchronizing signals.

In the one-way system embodiment, the remote responder stations only signal the central station when alarm data is present. The individual remote responder stations have clock means that causes the stations to transmit a test signal at least once every twenty-four hours. By changing the clock signal, the frequency of the test signal can be increased. The central station records the fact that the remote stations have made check-in transmissions. The central station also tests the strength of the transmitted signals, for the purpose of detecting possible power failure, and stores this information in the memory of the central station computer means for display at some later time on the output means of the central station.

In the alternative embodiment, this invention relates to a two-way radio frequency system which employs an existing FM transmitter or the subcarrier allocation of an existing broadcast band FM transmitter. The transmitter is two watt frequency modulated in either the UHF or VHF band depending on local band loading. The present example is a UHF transmitter operating in the 450 to 470 MHz band. The central station emits a periodic synchronizing signal to a plurality of transponders located at the remote responder stations. The transponders use the synchonizing signal as a timing signal and respond to the synchronizing signal with a radio transmission which is offset in time by an amount which identifies, to a computer means at the master station, the address of the particular remote responder station at which the interrogated transponder is located. This two-way radio frequency system is capable of accommodating up to 2,048 remote transponders.

In the two-way system embodiment, each of the 2,048 remote transponders will be allotted 90 milliseconds to respond in the form of two eight-bit words each containing identical informaton. When the two eight-bit words are received at the master or central station, they are compared. If the signals fail to match, the particular transmission will be treated as void and the master station will wait for the next scan. Since all remote responder stations are constantly listening for this synchronizing signal, it is possible to interrupt the data stream by reissuing the synchronizing signal whenever it is desirable to restart the scan. By this method more secure locations can be installed at low order addresses insuring a more rapid scanning if necessary. Accordingly, the present long range wireless alarm monitoring system permits 1,000 transponders to be interrogated by the central station transmitter every 90 seconds, thus exceeding the Underwriters' Laboratories standard.

Both Underwriters' Laboratories and the National Fire Protection Association allow up to a 200 second interrogation time. It is therefore possible to extend the response time for 1,000 remote responder stations to 200 seconds allowing 200 milliseconds per transmission. Adopting this scheme, however, involves using an alternative transmission scheme that forces each transmitter at a remote responder station to transmit asynchronously whenever it has alarm data. The reason for this is that Underwriters' Laboratories requires that 50 alarms be processed in 90 seconds while allowing an interrogation time of 200 seconds. Thus, to meet the faster requirement, the system of the present invention allows an interrogation time of 90 milliseconds thereby assuring that although a remote responder station can be interrogated only once every 200 seconds to determine whether or not it is on line, alarm data is transmitted within 90 seconds for a 1000 unit remote responder system.

Remote sensing units for detecting various physical conditions are coupled to the transponder at the remote responder station. The remote sensing unit comprises transducer means for converting any detected change in the physical condition under observation to an electronic impulse. Logic means are interposed between the transducer means and the transponder for converting the signal to digital form. Each physical condition under observation represents one bit in a multi-bit word. A change in any one bit causes the transponder to transmit alarm information to the central station. The remote station further comprises a logic means for determining the priority of the electronic impulses according to a predetermined protocol, essentially high priority and low priority signals. For instance, signals recording the opening and closing of protected premises may be suppressed, as low priority signals, during normal business hours while information regarding smoke, fire or hold-up are regarded as high priority signals and may be transmitted at any time. Finally, there is a transmitting means for transmitting signals to the central station.

The transponder hardware, contained in the remote responder station, is comprised of a UHF receiver, a UHF transmitter, an RF splitter and a microprocessor controller with the appropriate interface for transducers that sense any number of physical conditions such as, but not limited to, heat, cold, water, smoke, intrusion, and panic. The transponder receiver will always be tuned to the central station transmitter frequency and listening for synchronizing signals or commands. Upon receipt of either, the transmitter will then transmit the appropriate response, either alarm data or a command verification, only at the appropriate time slot. Alternatively, the remote responder station will transmit high priority data upon a change of state in a remote sensing unit.

Whenever loss of primary electric power is detected by the remote responder station, one bit of the transmitted message will indicate this fact to the central station during a regular transmission. The remote responder station will no longer transmit in anymore of its time slots beyond that point until power is restored. This procedure prevents discharging the remote responder station's battery.

In both of the above described alternative embodiments, the central station comprises a receiver means for receiving signals from the remote responder stations, transmitter means for sending synchronizing signals or commands to the remote responder stations, computer means for processing the received signals to determine the identity of the remote responder station and to interpret the signal for determining the particular status of each physical condition being monitored; and output means for displaying the status of the remote sensing unit.

Two types of commands can be issued from the central station: high priority commands and low priority commands. The high priority commands are those that cannot be acted upon until it is known to an absolute certainty that the remote responder station has indeed received the command from the central station. The low priority commands do not have this protocol and can be acted upon without notifying the central station. It is envisioned that the former would be implemented as follows: a special transponder would be designed such that whenever a command is issued the transponder would echo back the command to the central station. If the command is properly received back at the central station, the next scan would issue a command telling the transponder to act on that command. The transponder would then echo back notification that it is performing this command. In the low priority version, commands such as ring-back would merely be issued and acted upon without feedback.

Commands will be issued during the 90 second scan time just prior to the individual time slot of each remote responder station. Several commands that have to be issued can be stacked in the computer at the central station and issued when appropriate.

Although central station transmitters having two-way voice capability are permitted to use their existing apparatus to transmit alarm data on a non-interfering basis, the Federal Communications Commission requires that priority be given to the two-way voice transmissions. This is obviously incompatiable with a security system which must give high priority to alarm data. The instant wireless alarm monitoring system therefore contemplates using a subaudible tone in such central station systems only as a synchronizing mechanism for the transponders at the remote responder stations. When the central station transmitter is transmitting voice signals, the synchronizing signal will be introduced automatically together with the audio transmission, and transmitted whenever appropriate. The system is adapted so that the subaudible tone mode of the transmitter is activated and deactivated automatically whenever appropriate, whether the central station transmitter is, or is not, sending out voice signals.

In all embodiments of the invention a plurality of remote sensors capable of detecting a multitude of physical conditions are used. Examples of the types of monitored physical conditions contemplated by the invention are fire, smoke, water, or any other physical quantity capable of being measured. It is also contemplated that special features can be built into the system such as intrusion detection, that is, detecting the presence of a person or thing in an unauthorized area. In those circumstances where a security system of the present invention is employed to protect people, facility is made for a panic switch that would automatically and immediately signal the central station that an emergency condition existed. It is also foreseen that the present invention would be useful for monitoring and controlling various industrial processes.

BRIEF DESCRIPTION OF THE DRAWINGS

The accompanying drawings illustrate the invention. In these drawings.

PREFERRED EMBODIMENT

Figure 1:
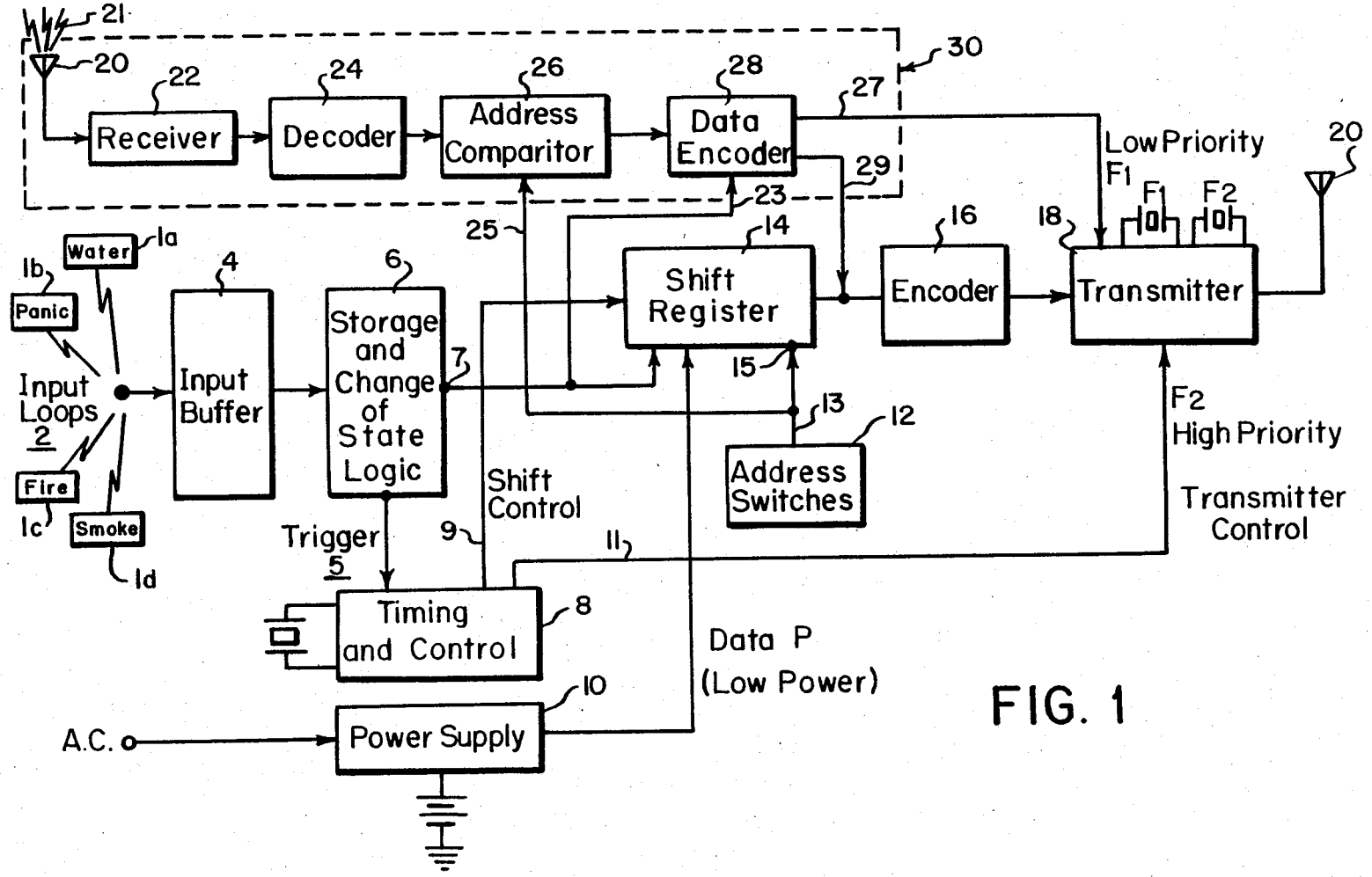
FIG. 1 is a block diagram of the combined one-way and two-way remote responder station.

Referring to FIG. 1, there is shown in that portion of the drawing not enclosed by the dashed lines the preferred embodiment of a remote responder station for the one-way system. Remote sensing units 1a–1d monitor physical conditions such as, but not limited to, smoke, fire, water, intrusion and emergency and are tied to input loops 2. Each remote sensing unit represents one input loop. Input buffer 4 gates the signal from the remote sensing unit to storage and change of state logic 6. In the event storage and change of state logic 6 detects a change in the condition of one or more of the input loops, it conveys a trigger pulse 5 to timing and control 8. Upon receiving trigger pulse 5, a shift control signal 9 is conveyed to shift register 14 whereupon the new multi-bit word produced by storage and change of state logic 6 is conveyed along coupling means 7 to an input of shift register 14. Address switches 12 present signal 13 to input 15 of shift register 14. Shift register 14 conveys the new multi-bit word from change of state logic 6 and the address signal 13 to encoder 16 wherein the information is coded in serial form for transmission by transmitter 18.

In the preferred embodiment of the two-way system the circuitry represented by that portion of FIG. 1 enclosed in the dashed lines 30 is added to the basic one-way system. Synchronizing radio signal 21 is received at receiver 22 by way of antenna 20. The radio signal is decoded by decoder 24 and the address encoded in the synchronizing signal is compared at address comparator 26 with the address of the remote responder station as set by address switches 12. If the address of signal 21 matches the address of address switches 12, data encoder 28 is enabled and the output of storage and change of state logic 6 is presented to the data input of data encoder 28 for encoding and presentation to transmitter 18. Data encoder 28 also suppresses low priority alarm data by presenting the appropriate signal to transmitter 18. F1 and F2 are crystal oscillators. Low priority alarm data is transmitted using a radio frequency produced by crystal oscillator F1 and high priority alarm data is transmitted using a radio frequency produced by crystal oscillator F2. The radio transmission is made using antenna 20.

Figure 2:
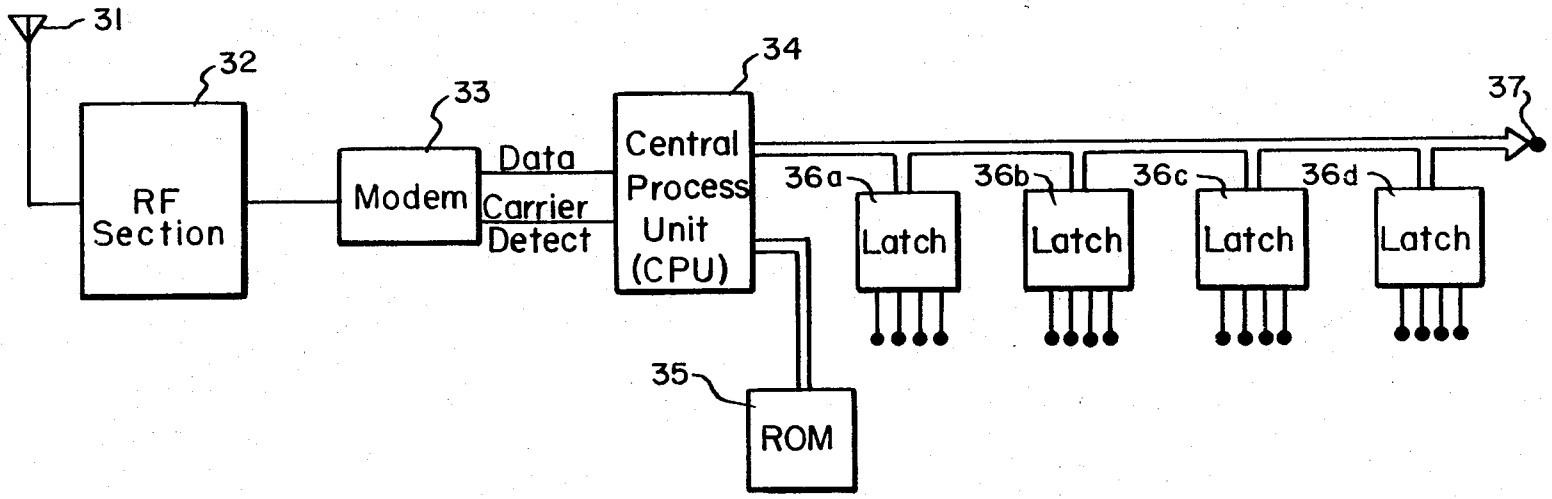
FIG. 2 is a block diagram of the central station.

Referring to FIG. 2, RF section 32 transmits and receives radio signals via antenna 31. RF section 32 is connected to modem 33 where data signals are sent and received from CPU 34 and are converted to or from, as the case may be, audio signals. ROM 35 is in two-way communication with CPU 34. Latches 36a–36d are in direct communication with CPU 34. Finally, tie-point 37 is provided so that the system can be directly connected to a telephone.

Figure 3:
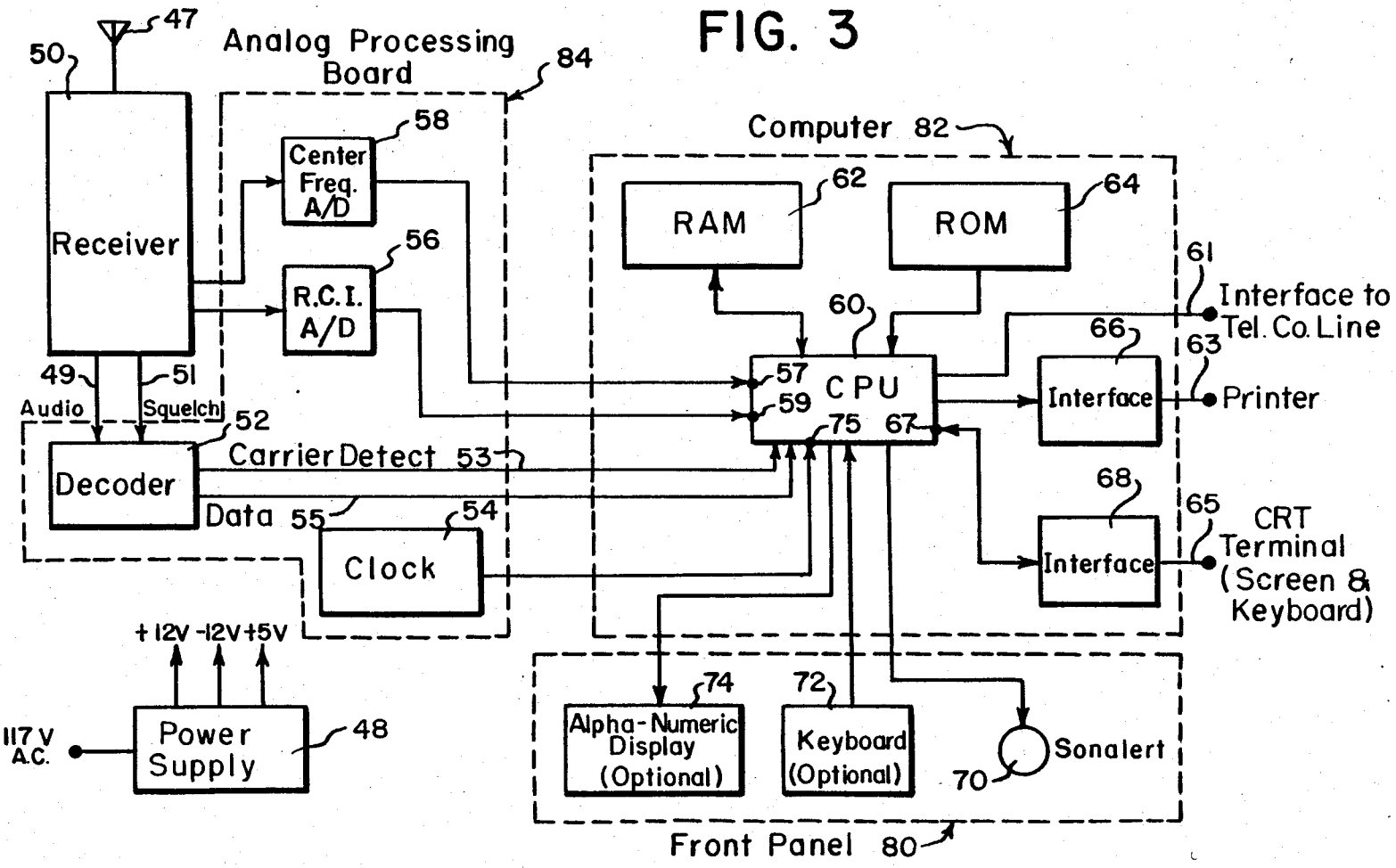
FIG. 3 is an expanded block diagram of the central station.

FIG. 3 shows the preferred embodiment of a central station for a one-way system. Signals from the remote responder units are received by receiver 50 over antenna 47. Decoder 52 decodes audio signal 49 received from receiver 50 and then transmits the decoded signal to CPU 60 along data line 55. Clock 54, center freq. 58 and R.C.I. A/D 56 are provided for controlling the timing of the system and gating signals between receiver 50 and CPU 60. RAM 62 and ROM 64 provide memory means for CPU 60. Interface means 66 and 68 are provided to connect the various display means 63 and 65 to CPU 60. Alpha-numeric display 74, keyboard 72 and sonalert 70 are shown as optional elements connected to CPU 60. Finally, power supply 48 is the primary source of electric power to the central station.

Figure 7:
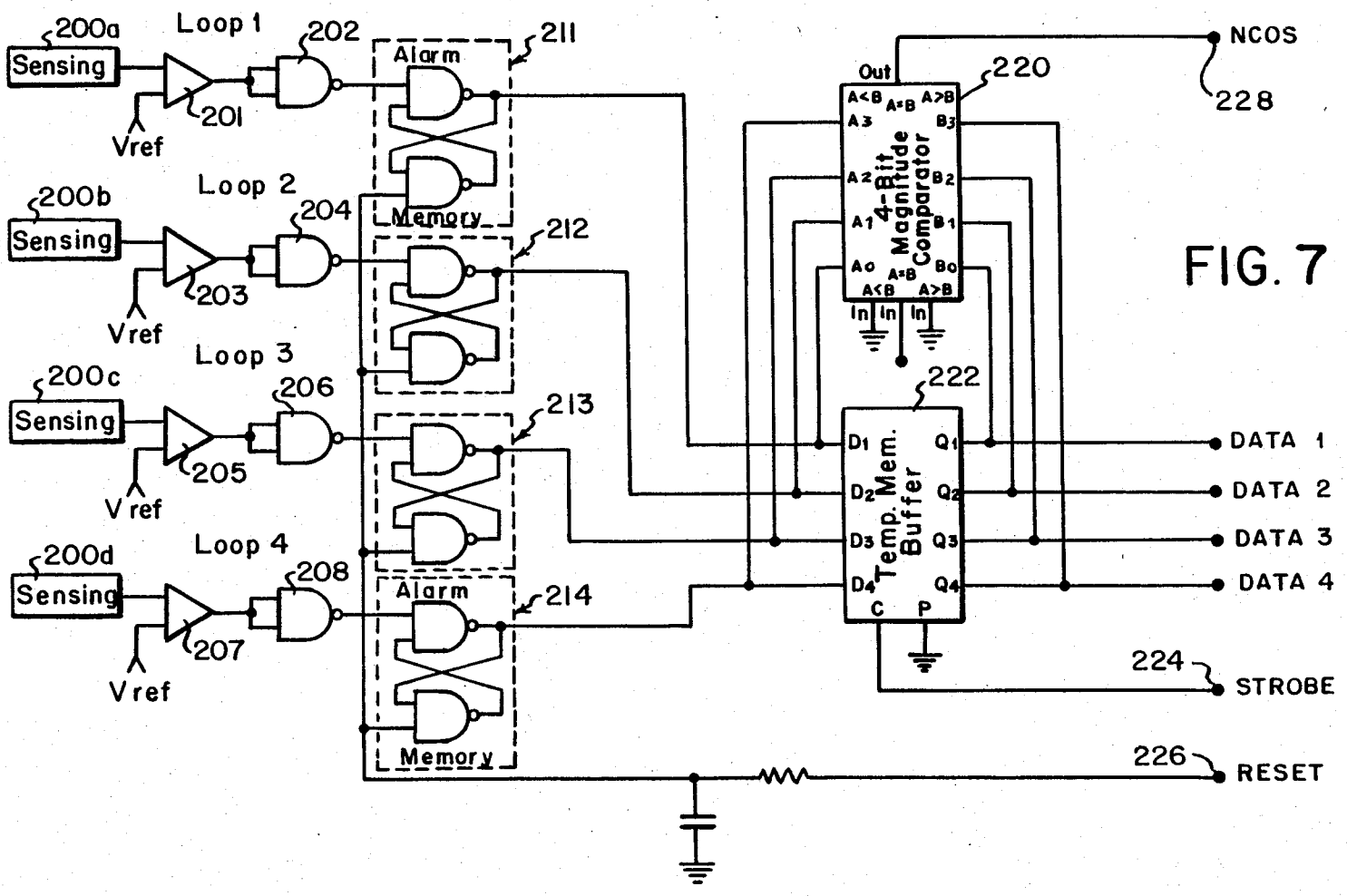
FIG. 7 is a schematic diagram of the remote responder station input circuitry coming from the remote sensing units.
Figure 8:
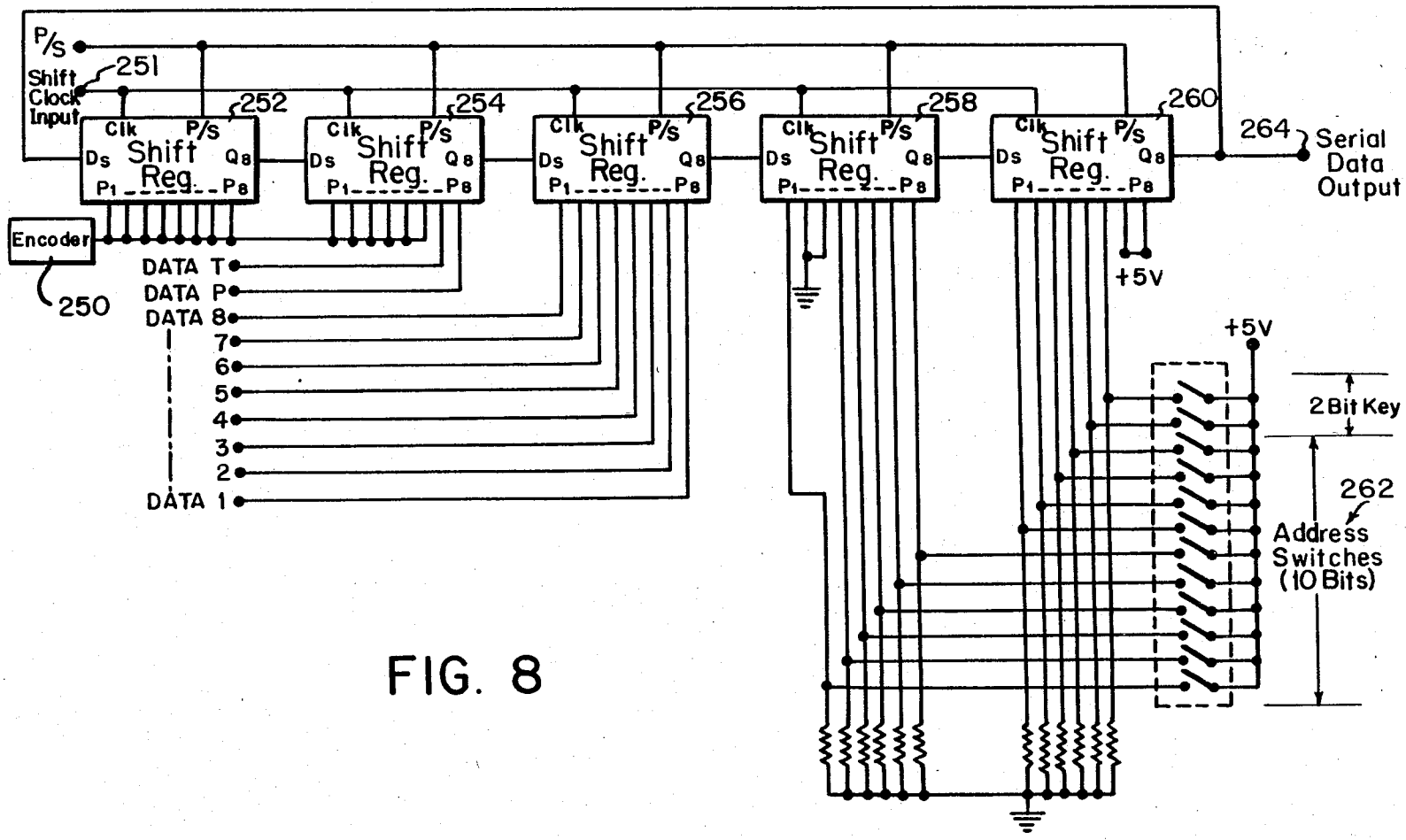
FIG. 8 is a schematic diagram of the remote responder station encoder.
Figure 9:
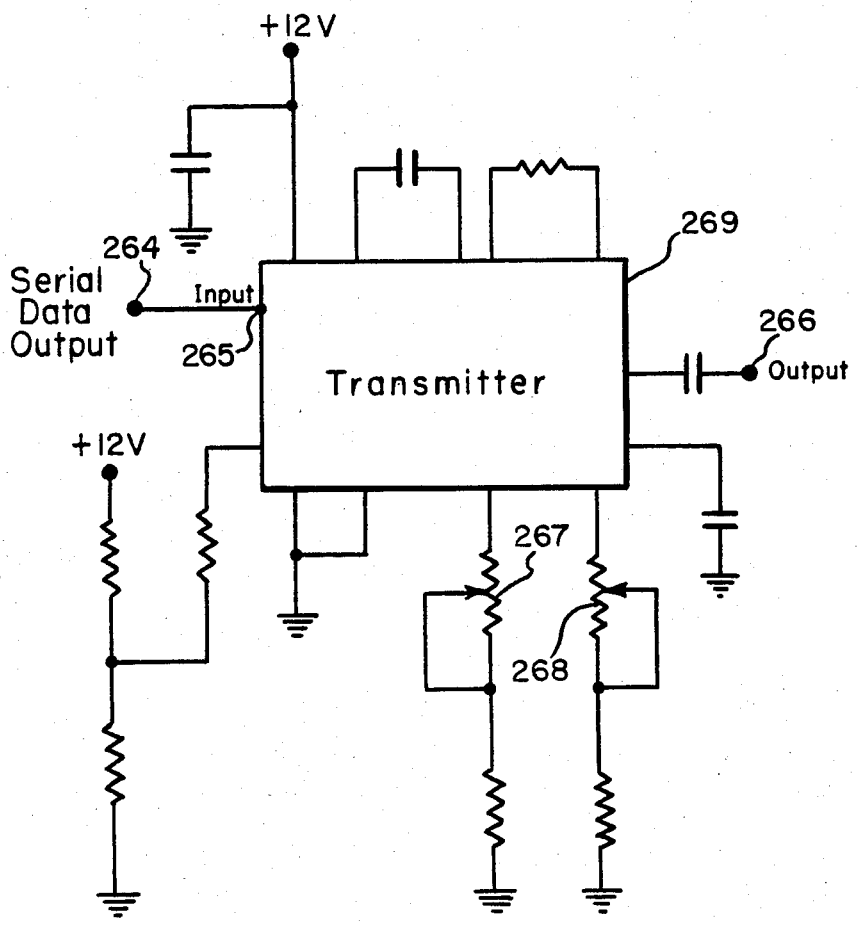
FIG. 9 is a schematic diagram of the remote responder station transmitter.

Now referring to FIGS. 7 through 9 the various components described in FIG. 1 are more fully developed. Referring to FIG. 7, sensing unit 200 is connected to independent comparator 201 which monitors the input zone of sensing unit 200 for a drop in voltage caused by an actuation of an input device of the sensing unit 200. Interposed between independent comparator 201 and alarm memory 211 is input buffer 202. Alarm memory 211 is comprised of two two-input NAND gates connected as RS flip-flops. The output of alarm memory 211 is connected to 4-bit magnitude comparator 220 and temporary memory buffer 222. The inputs of 4-bit magnitude comparator 220 are also tied to the output of temporary memory buffer 222. When 4-bit magnitude comparator 220 senses a change between the four sets of inputs it outputs a NCOS pulse along line 228 causing a transmission to occur.

Referring now to FIG. 8, the outputs of temporary memory buffer 222 in FIG. 7 appear as signals DATA 1 through DATA 8 at the inputs of shift register 256. Encoder 250 inputs a unique code to shift registers 252 and 254 while address switches 262 input the remote responder station's particular address to shift registers 258 and 260. When the shift registers are all loaded with data to be transmitted, the information is serially outputted to a tone encoder connected at point 264.

Referring now to FIG. 9, a schematic diagram of the tone encoder is shown. Serial data from the serial data output 264 of the shift registers of FIG. 8 are inputted to tone encoder 269 at transmitter input 265. The encoded signal is outputted to the transmitter at tone encoder output 266. Variable resistors 267 and 268 are provided to adjust the high and low frequencies respectively.

Figure 4:
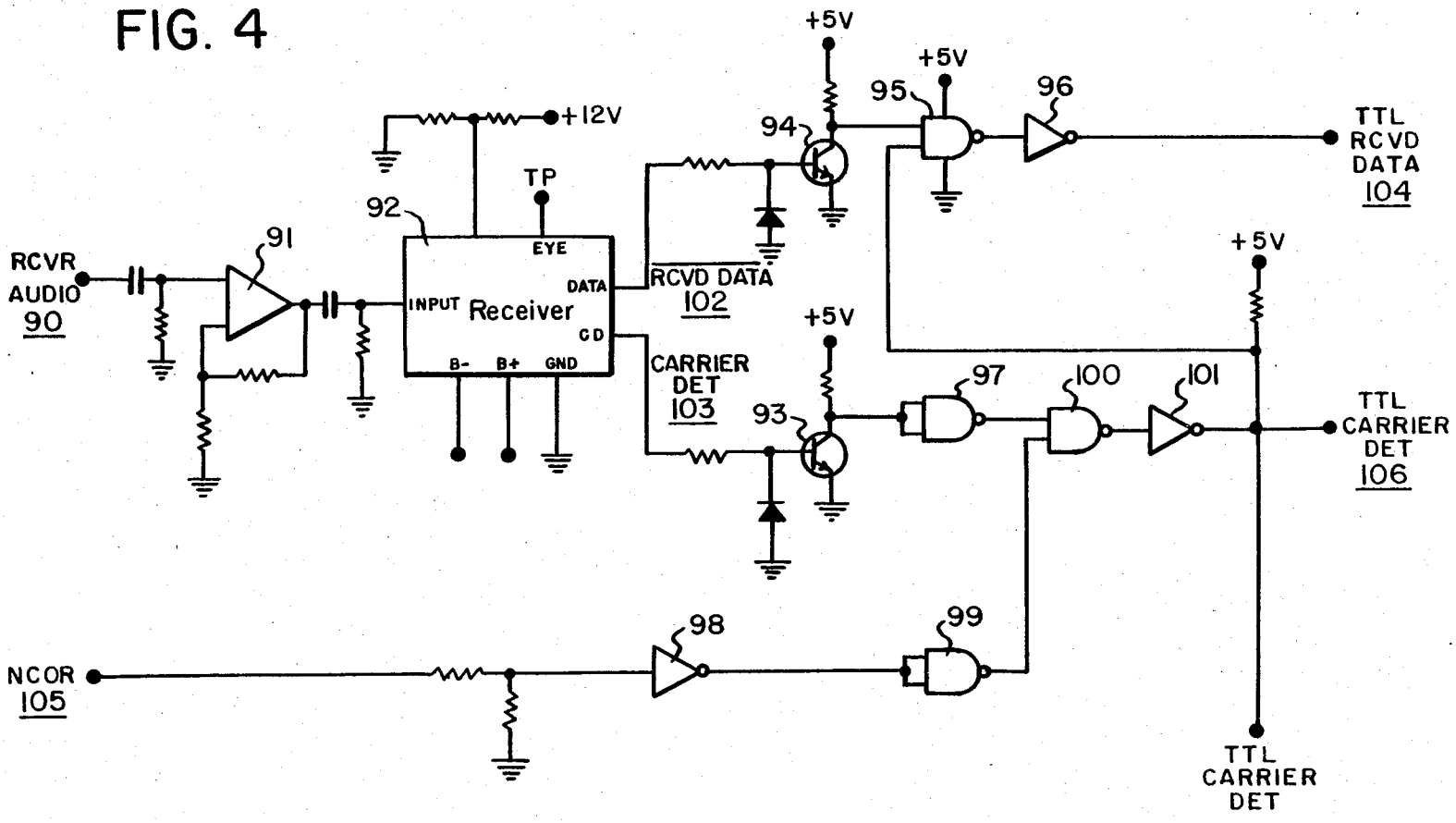
FIG. 4 is a schematic diagram of the central station receiver.

Referring now to FIG. 4, the preferred embodiment of a central station receiver is shown. The signals from the remote responder stations are presented at receiver audio input point 90. The signal is amplified by amplifier 91 then fed to receiver 92. Receiver 92 outputs a signal on RCVD DATA line 103 which switches transistor 94, on presenting a signal on TTL RCVD Data input 104 via NAND gate 95 and invertor 96. Receiver 92 also outputs a signal on carrier detect line 102 that switches transistor 93 on. This signal is combined with COR signal 105 at NAND gate 100 presenting a signal on TTL CARRIER DET line 106.

Figure 5:
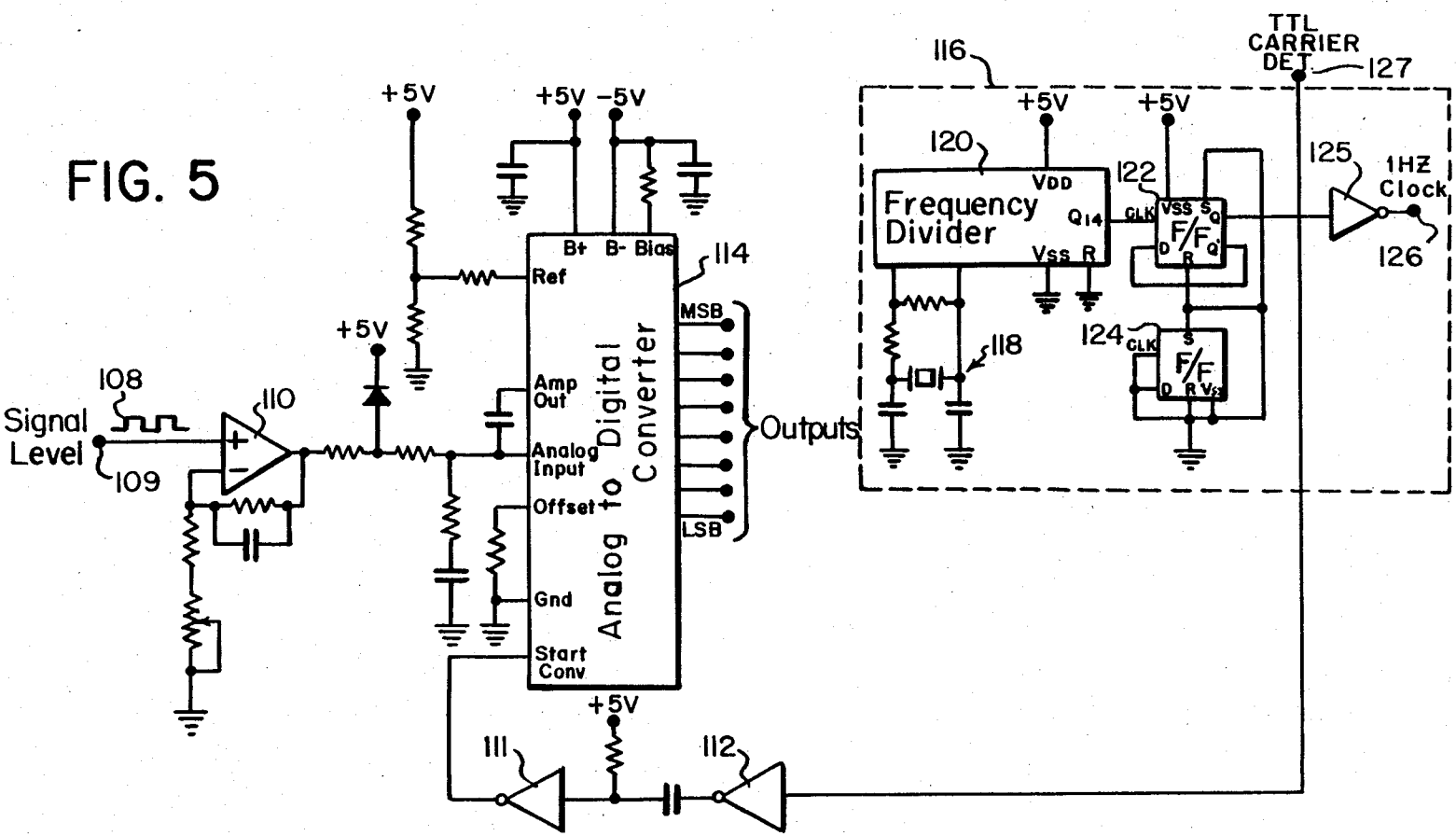
FIG. 5 is a schematic diagram of the central station decoder.

Referring to FIG. 5, the circuitry for monitoring the signal level of the remote responders stations is shown. The signal 108 is presented at the signal level input 109 of amplifier 110. The amplifier signal is then presented to analog-to-digital (A/D) converter 114. The A/D converter 114 produces a digital output representative of the signal level. The output of A/D converter 114 is also stored in microprocessor 136 of FIG. 6. In the dashed box 116 is shown a timing circuit that produces a clock pulse of 1 Hz.

Figure 6:
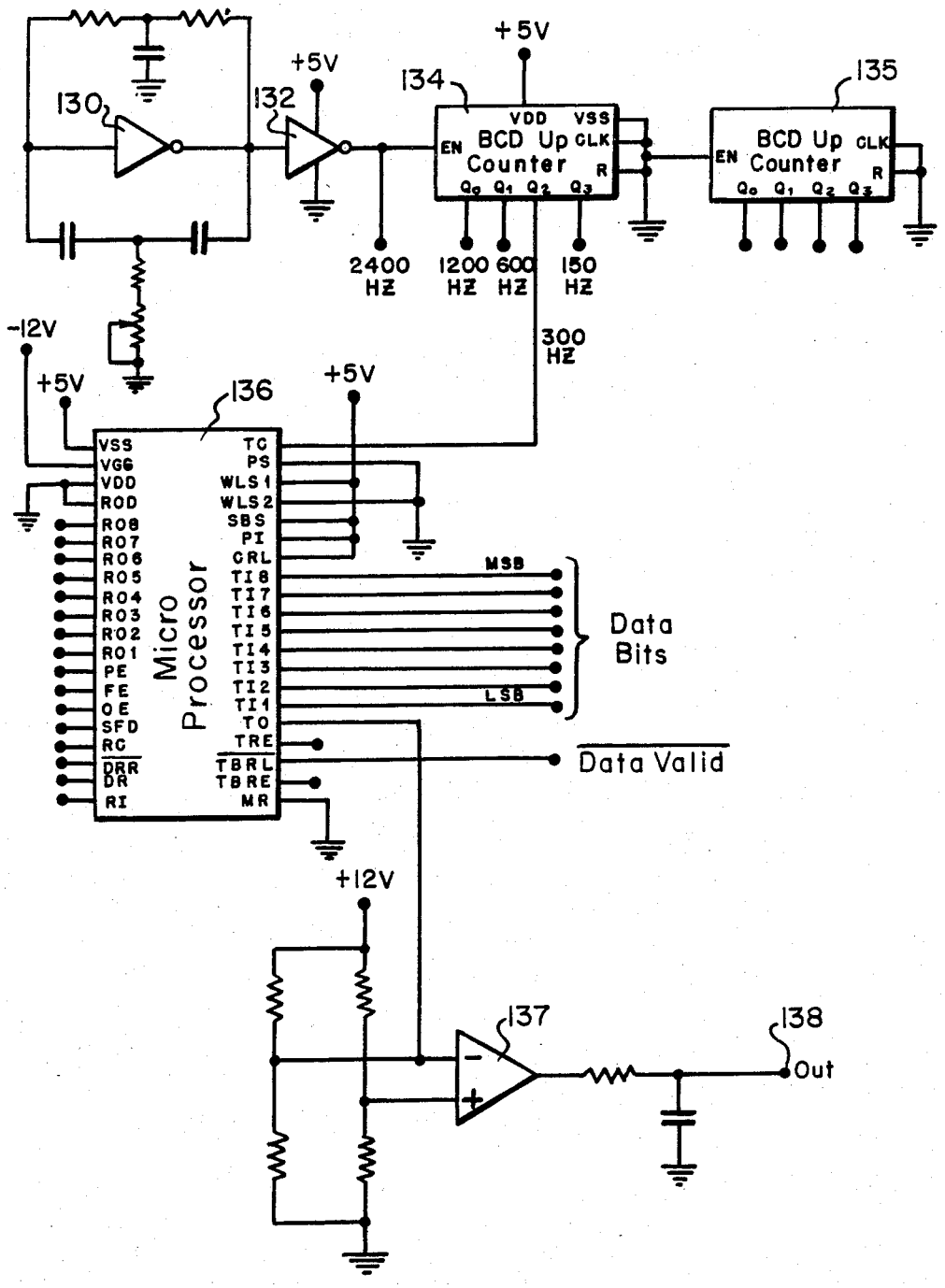
FIG. 6 is a schematic diagram of the central station computer means.

FIG. 6 shows the inputs and outputs of microprocessor 136 which acts as the central station computing means.

Although the invention has been described with respect to the preferred embodiment, it is not to be so limited in that changes and modifications may be made which are within the full intent and scope as defined by the appended claims.

I claim:

1. A long range wireless alarm monitoring system which employs an existing FM transmitter or a subcarrier allocation of an existing broadcast band FM transmitter, said system comprising:

a central station;

a plurality of remote responder stations capable of operating in either one-way or two-way communication with said central station, each remote responder station having clock means for measuring elapsed time, a radio frequency transmitter, one or more transducer means for sensing physical conditions, encoder means for producing a unique multi-bit word and control means for controlling said clock means, said transmitter and said transducer means;

said control means causing said transmitter to transmit a repeated signal comprised of said unique multi-bit word when said transducer means senses a change in a sensed physical condition and said control means further causing said transmitter to transmit said repeated signal indicating the operating state of said remote responders upon said clock means indicating a predetermined elapsed time;

said central station having receiver means for receiving transmissions from said remote responders, decoder means for decoding said repeated signals and information processing means associated with said receiver means and said decoder means for processing said decoded signals, said information processing means including output means for displaying the results of said processing.

2. A long range wireless alarm monitoring system which employs an existing FM transmitter or a subcarrier allocation of an existing broadcast band FM transmitter, said system comprising:

a central station in either one-way of two-way radio communication with one or more remote responder stations, said central station having signal generating means to generate a synchronizing signal, transmitter means connected to said signal generating means for transmitting said synchronizing signal, receiver means associated with said transmitter means to receive a coded response signal from said remote responder stations, logic means connected to said receiver means for determining the validity of the coded response signal, computer means connected to said logic means and associated with said transmitter means and said receiver means for controlling the transmission of said synchronizing signal and for controlling the reception of said coded response signal and for processing said coded response signal, and display means connected to said computer means for issuing an alarm in response to said coded response signal;

each of said remote responder stations having transmitter means for transmitting a coded response signal to said central station, receiving means to receive the synchronizing signal from said central station, address comparator means connected to said receiver means for comparing said synchronizing signal with a predetermined coded address of the remote responder station, time delay means associated with said receiver means for delaying said response signal by a specific interval of time, said time interval being unique to each individual remote responder station, encoder means associated with said transmitter means for producing a unique multi-bit word determined by the condition of one or more remote sensing units linked in direct communication with said remote responder station and a gating means associated with said encoder means for gating said unique multi-bit word to said transmitter means for transmission to said central station.

3. The alarm processing system of claim 2 wherein said central station transmitter means is a commercial broadcast transmitter and said central station transmitter signals are transmitted by said transmitter without interfering with said transmitter's normal operations.

4. For a long range wireless alarm monitoring system which employs an existing FM transmitter or a subcarrier allocation of an existing broadcast band FM transmitter, the method comprising:

detecting environmental conditions in the immediate vicinity of a remote responder station;

converting the detected environmental condition to an information signal;

directing said information signal to a coding means associated with said remote responder station for multi-bit coding;

coding said information signal to produce a coded multi-bit information signal;

gating said coded multi-bit information signal to a transmitter means associated with said remote responder station;

generating a synchronizing address signal at a central station;

transmitting said synchronizing address signal from said central station;

receiving said synchronizing address signal generated by said central station at said remote responder station;

comparing said synchronizing address signal with a predetermined coded address of said remote responder station;

performing the function of responding to said synchronizing address signal when said synchronizing address signal is identical to said predetermined coded address;

delaying a response to said synchronizing address signal by an amount of time depending upon the location of said remote responder station;

transmitting said coded multi-bit information signal in response to said synchronizing address signal;

receiving said coded multi-bit information signal at said central station;

decoding said coded multi-bit information signal at said central station;

comparing said decoded multi-bit information signal to test the validity of said transmitted coded multi-bit information signal; and processing said decoded information signal for response with an appropriate alarm signal.

* * * * *

UNITED STATES PATENT AND TRADEMARK OFFICE

CERTIFICATE OF CORRECTION

PATENT NO. : 4,511,887

DATED : April 16, 1985

INVENTOR(S) : Louis T. Fiore

It is certified that error appears in the above-identified patent and that said Letters Patent is hereby corrected as shown below:

Column 1, line 43, "inherrently" should be -- inherently --;

Column 1, line 59, "et al shows." should be -- et al. shows --;

Column 2, line 5, "reduntant" should be -- redundant --;

Column 2, line 6, "comparision" should be -- comparison --;

Column 2, line 41, "comparision" should be -- comparison --;

Column 8, line 34, "of" should be -- or --.

Signed and Sealed this

*Twenty-fourth* Day of *September 1985*

[SEAL]

*Attest:*

*Attesting Officer*

DONALD J. QUIGG

*Commissioner of Patents and Trademarks—Designate*